US006259591B1

(12) United States Patent
Pitel et al.

(10) Patent No.: US 6,259,591 B1
(45) **Date of Patent: *Jul. 10, 2001**

(54) APPARATUS AND METHOD FOR MONITORING OF AIR IONIZATION

(75) Inventors: Ira J. Pitel, Morristown, NJ (US); Mark Blitshteyn, New Hartford, CT (US)

(73) Assignee: Ion Systems, Inc., Berkeley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/590,193

(22) Filed: Jun. 8, 2000

Related U.S. Application Data

(63) Continuation of application No. 09/311,775, filed on May 13, 1999, now Pat. No. 6,130,815, and a continuation-in-part of application No. 09/103,796, filed on Jun. 24, 1998, now Pat. No. 6,088,211, which is a continuation-in-part of application No. 08/966,638, filed on Nov. 10, 1997, now Pat. No. 5,930,105.

(60) Provisional application No. 60/116,711, filed on Jan. 20, 1999.

(51) Int. Cl.[7] ..... H05F 3/06

(52) U.S. Cl. ..... 361/212; 361/213; 361/229; 361/235

(58) Field of Search ..... 361/212, 213, 361/220, 225, 229, 230, 235; 250/324–326

(56) References Cited

U.S. PATENT DOCUMENTS 5,930,105 * 7/1999 Pitel et al. ..... 361/212
6,088,211 * 7/2000 Pitel ..... 361/212
6,130,815 * 10/2000 Pitel et al. ..... 361/212

* cited by examiner

*Primary Examiner*—Fritz Fleming
(74) *Attorney, Agent, or Firm*—Fenwick & West LLP

(57) ABSTRACT

The total of the ion current leaving electrodes of one polarity and the ion current flowing to those electrodes, is measured as the current in the ground return path of the corresponding generator. For a brand-new ionizer, the value of that total ion current for electrodes of each polarity under normal operating conditions will substantially be the maximum ion current the positive and negative electrodes are capable of generating. The changes in the current in the ground return path reflect changes in the ionizing efficiency of the electrodes caused among other factors, by contamination. The values of the currents may be scaled up or down to the arbitrary unit. Using this scaling allows to have a signal that is normalized regardless of the length of the ionizer and number of the ionizing electrodes.

19 Claims, 6 Drawing Sheets

APPARATUS AND METHOD FOR MONITORING OF AIR IONIZATION

CROSS-REFERENCE TO RELATED APPLICATIONS

The present application is a continuation Ser. No. 09/311,775 of U.S. Pat. No. ,6130,815 filed on May 13, 1999 and entitled "Apparatus and Method for Monitoring of Air Ionization", which claims the benefit of United States provisional application Ser. No. 60/116,711, filed Jan. 20, 1999 by Ira J. Pitel and Mark Blitshteyn having the same title. Both the present application and U.S. Pat. No. 6,130,815 are continuations-in-part of Ser. No. 08/966,638 filed Nov. 10, 1997 U.S. Pat. No. 5,930,105 entitled "Method and Apparatus for Air Ionization" and Ser. No. 09/103,796,filed Jun. 24 1998 U.S. Pat. No. 6,088,211 entitled "Safety Circuitry for Ion Generator".

Field of the Invention

This invention relates to controlling static charge on work pieces. More particularly, this invention relates to air ionizers for controlling static charge on moving webs of non-conductive material.

Background of the Invention

Many industrial operations are confronted by the build up of static charge on work pieces which then contribute to undesirable particulate contamination, unwanted movement, or other undesirable physical parameters associated with the work pieces. In the preparation of continuous films of sheet plastic materials, extended lengths of non-conductive plastic films pass rapidly over one or more rollers and accumulate substantial electrostatic charge that then attracts surface contaminants, and inhibits tight compaction in take-up rolls, impedes surface coating processes, and otherwise interferes with safe processing of the films.

Air ionizers, designed in a shape of a rod or a bar, are commonly positioned in close proximity to such moving webs to supply positive and negative ions for substantially neutralizing static charge on the web material. These air ionizers commonly contain pointed ionizing electrodes and operate at voltages of several kilovolts supplied to the ionizer via cables from remote generators positioned away from the ionizer. In large industrial applications, such webs may be several feet wide, operate at high linear speeds, and exhibit wide variations in the amount of static charge requiring neutralization at any given time or location along the moving web.

Typically, ionizing currents of about 1 to 5 microamperes per linear inch of the moving web are required for neutralization. The webs may vary in widths from several inches to 20 feet. This requires that the generators which supply such ionizers be capable of sustaining the output current of about 1–5 milliamperes at voltage levels of about 3–15 kilovolts.

There is a common problem with all air ionizer. This problem is dirt and residue accumulation on the tips of ionizing electrodes that limits their ionizing efficiency.

A problem with conventional ionizers that there is no economical and practical way to measure and monitor the ionizing efficiency of the electrodes without employing complex sensors and circuitry. For air ionizers with generators that produce high voltage output of the alternating current power at the power line frequency(AC) the difficulty of measuring the ionizing efficiency arises from the fact that the alternating potential applied to the electrodes couples capacitively to the electrically grounded components of the ionizer and the generator to produce a significant capacitive current that has a different phase and can substantially exceed the ionizing current.

For instance, in U.S. Pat. No. 5,017,876 the monitoring of the ion current from discharge electrodes of an AC ionizer is accomplished with a use of one or more sensors adjacently spaced from discharge electrodes. In one example of that device, one sensor picks up a capacitive current signal, while a second sensor picks up the total signal which represents the sum of the capacitive and corona (ion) currents. The outputs of the sensors are coupled to electronic circuitry, such as differential amplifier, to separate capacitive current from the total current signal. The problem with this approach, is that it requires adding sensors to the ionizer's construction. That increases the cost and manufacturing complexity of the equipment.

European Patent Application No. 97116167.4 (EP 0 844 726 A2) describes a different approach to detection of contamination on the discharge electrodes of an AC ionizer. In this application a complex electronic circuit with a microprocessor is employed to monitor and process a signal representing the output current of a high voltage AC transformer.

In another European Patent Application No. 97112236.1 (EP 0 850 759 A1) describes a system which includes an ionizer bar and circuitry for detection of contamination on ionizer electrodes. In order to achieve that the ionizer bar contains, in addition to ionizer electrodes, multiple contamination detecting sensors imbedded into the bar's body. That increases the cost and manufacturing complexity of the equipment.

SUMMARY OF THE INVENTION

In accordance with the method of the present invention, the ionizer measures and monitors its ionizing efficiency without employing dedicated sensors or a complex circuitry. In accordance with the present invention, two high voltage generators are operated to produce positive or negative voltages of about 3–15 kilovolts. The positive high voltage and negative high voltage are supplied to separate respective electrodes that are positioned in close proximity to the work piece (e.g., a moving web) to be neutralized with air ions. The positive generator output voltage can be made higher than the output voltage of the negative generator due to lower negative ionization onset level and higher mobility of negative ions. This is done in order to avoid unintentional application of charges on to a web.

The generators which apply high voltages of predetermined polarities to the respective electrodes include ground return electrical paths through which electrical charges are conducted away from the generators at rates corresponding to the rates of ion currents conducted by the respective electrodes into the air in their vicinities. Associated metering circuitry is placed in each of the ground return electrical paths.

In accordance with the illustrated embodiment of the present invention, the ionizing electrode of one polarity is positioned in close proximity to an electrode of the opposite polarity, and the sufficient potential difference is established between the electrodes. As a result, the positive electrodes act as the electrical potential reference for the negative electrodes positioned in close proximity thereto, and the negative electrodes act as the electrical potential reference for the positive electrode, to produce the desirable intense electrical field required for generation of air ions.

With the sufficient electric field at the ionizing electrodes, that is due to their close proximity to the electrodes of the opposite polarity and the potential difference between the electrodes, a certain ionizing current from positive electrodes flows to the negative electrodes, a certain ionizing current from negative electrodes flows to the positive electrodes. In the absence of an external electrostatic field from a surface, such as moving web, in the vicinity of the ionizer electrodes, substantially all ion currents flow between the electrodes of opposite polarities, and the currents in the ground return paths of each generator will be close to the maximum possible current. Measuring the magnitude and changes in these currents makes it possible to ascertain the changes in the ionizing efficiency of the ionizer.

If the web carries surface charge, the associated external electrostatic field causes ions of the polarity opposite to the polarity of the surface charge on the web to leave the ionizer electrodes and flow to the charged surface. For example, when the moving web carries a negative electrostatic charge, its electrostatic field attracts the ions from positive electrodes. As a result, some positive ion current flows to the moving web to neutralize its surface charge, while IS the rest of positive ion continue flowing to the negative electrodes. At the same time the ion current from the negative electrodes significantly flows to the positive electrodes.

The outcome of this redistribution of the destinations for various ion flows is that substantially the same positive ion current, as under the no-external electrostatic field conditions, leaves the positive electrode, and substantially the same negative ion current arrives to the positive electrode, and therefore the current in the ground return path of the positive generator is substantially the same as before the introduction of the external electrostatic field. On the other hand, while the same negative ion current, as under the no-external electrostatic field conditions, leaves the negative electrode, the value of positive ion current arriving to the negative electrode has diminished by the amount of positive ion current that now flows to the charge surface (web). Therefore, the current in the ground return path of the negative generator is lower than before the introduction of the external electrostatic field by the value of the current going to the web.

The total of the ion current leaving electrodes of one polarity and the ion current returning to those electrodes, is measured as the current in the ground return path of the corresponding generator. For a brand-new ionizer, the value of that total ion current for electrodes of each polarity under normal operating conditions will substantially be the maximum ion current the positive and negative electrodes are capable of generating.

In another embodiment of this invention the values of the currents are scaled up or down to the arbitrary unit. Using this scaling allows to have a signal that is normalized regardless of the length of the ionizer and number of the ionizing electrodes.

Air ionizers that are used for neutralization of static charges in a heavy-duty industrial applications become quickly contaminated by the residue of the industrial process, dust, dirt, vapors of chemicals, etc. The contamination that settles on the ionizing electrodes of the ionizer diminish its capacity for ion current generation, and therefore, its neutralizing capacity.

As a result, the value of total currents flowing from and to the ionizing electrodes will continually diminish during the service cycle of the ionizer. According to this invention, by measuring and monitoring the normalized signals of the currents flowing in the return paths of the positive and negative generators, and comparing the measured values to the initial normalized value, the user will be able to continually ascertain the condition of the ionizer and the maintenance cycle. Furthermore, a maintenance schedule can be established by choosing an arbitrary value of the currents below which the ionizer will be considered inefficient for its purpose.

The associated high voltage generators may be of many different types for producing positive and negative voltages of different wave shapes and amplitudes. The advantage of the present invention is significantly increased when the two high voltage generators are of the type described in the U.S. patent application Ser. No. 08/966,638 and in the Continuation-in-Part application Ser. No. 09/103,796. Such generators are operated to produce positive or negative voltages of about 3–15 kilovolts during respective operational half-cycles at a selected switching or repetition rate. The high voltage generators include multiple stages of power conversion in which the high voltage output is produced by a high frequency inverter (operating typically at a frequency greater that 20 KHz). The alternating rate at which the generators are activated and inactivated may be in the range preferably between 50 cycles per second and 400 cycles per second. In operation during one half of the switching duty cycle, the first generator produces only positive half-cycles of high-voltage and the other generator is substantially inactive. Then, during the alternate half of the switching cycle, such other generator produces only negative half-cycles of high-voltage and the first generator is substantially inactive. In each half duty cycle of the applied AC power, the potential of ionizing electrodes connected to the active high voltage generator is elevated to air ionization levels while the ionizing electrodes connected to the inactive generator serve as a potential reference.

In one embodiment of the present invention, the output of the high voltage generators during their respective inactive half cycles are caused to be as close to the ground potential as possible to minimize the flow of ions from the active electrodes to the inactive electrodes, especially when an external electrostatic field is present in the vicinity of the ionizer. At the same time, the inactive electrodes at a ground potential still act as a sufficient electrical potential reference to the active ionizing electrodes to produce the desirable intense electrical field required for ionization. Bringing the outputs of the high voltage generators during their respective inactive half cycles to as close to the ground potential as possible is accomplished by placing a high voltage drain resistor between the output and the respective return path of each of the two generators.

The advantage of the circuit with two resistors becomes apparent in another embodiment of this invention, that allows simple and reliable metering circuitry to measure the current in the return paths of both generators.

DETAILED DESCRIPTION OF THE INVENTION

Figure 1A:
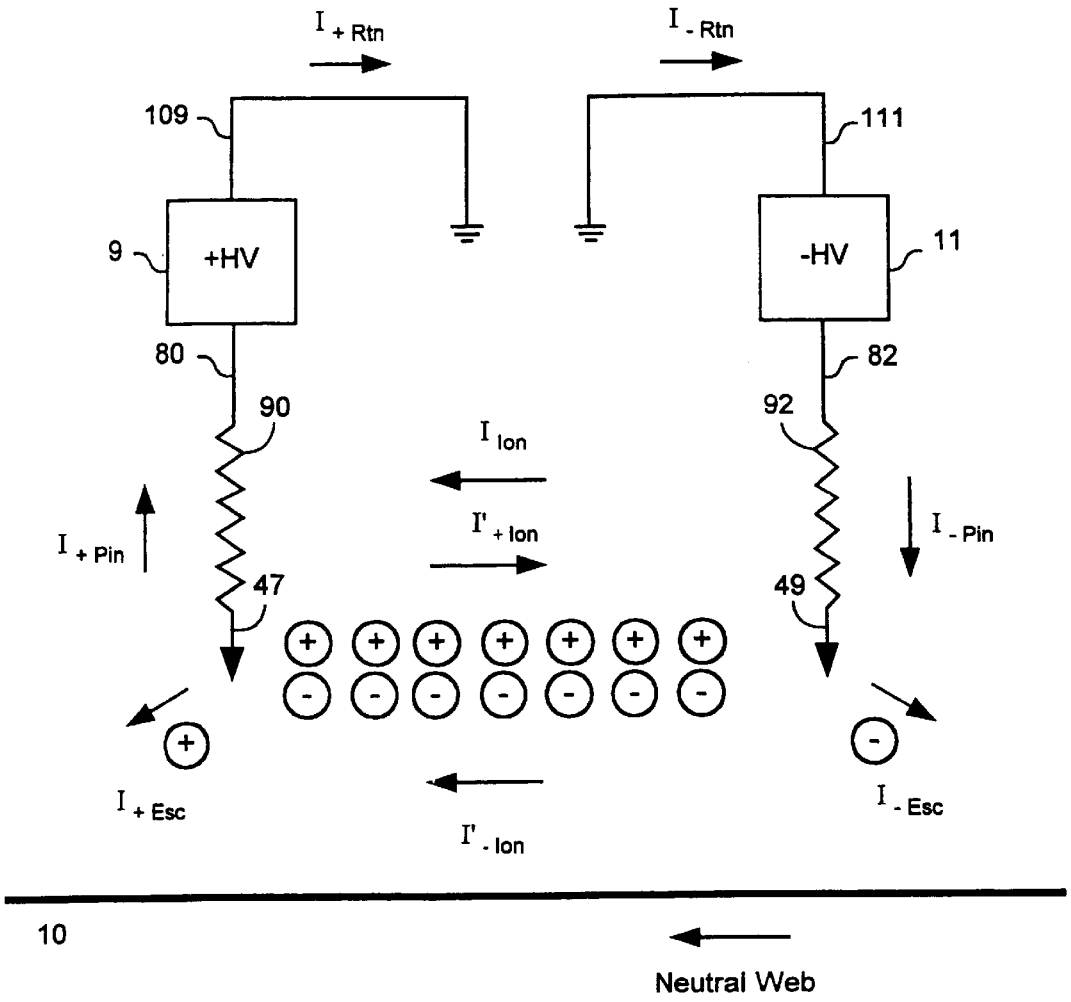
FIG. 1A shows a diagram of positive and negative ion currents and circuit currents in the ionizing method and device of the present invention in the absence of an external electrostatic field.

In accordance with the present invention, two high-voltage generators 9, 11 are operated, as illustrated in FIG. 1A, to produce only positive (or negative) high voltages on respective outputs 80, 82. The output voltages from each generator 9, 11 are supplied to respective ion emitter electrodes 47, 49 that are conventionally formed as sharp tips or points that are usually oriented toward a workpiece that is to be neutralized by the supplied ions. The positive output voltage is made higher than the output voltage of the negative generator in order to compensate for the lower negative corona threshold and higher negative ion mobility. Additional resistors 90, 92 of high resistance values (e.g., 20 to 200 megohms) may be connected between output terminals and ion emitter electrodes 47, 49 to limit maximum output current for safety purposes. The electrodes 47, 49 are positioned in close proximity to the work piece 10 (e.g., a moving web) to be neutralized with air ions. The generators which apply high voltages of predetermined polarities to the respective electrodes include ground return electrical paths 109 and 111 through which electrical charges are conducted away from the generators at rates corresponding to the rates of ion currents conducted by the respective electrodes 47 and 49 into the air in their vicinities and of the polarities opposite to those of the ion currents.

The total of the ion current leaving electrodes of one polarity and the ion current arriving to those electrodes, ($I_{-ion}+I_{+ion}$), is respectively designated as $I_{-pin}$, for the negative electrodes, and $I_{+pin}$, for the positive electrodes. A portion of ion current produced by the electrodes escapes the field of the electrodes of opposite polarity and leaves the ionizer. The escaped ion currents $I_{-esc}$ and $I_{+esc}$, reduce the value of ion current arriving to the electrodes. Each of these totals is measured as the current in the ground return path of the corresponding generator, are $I_{-rtn}$ and $I_{+rtn}$, respectively for negative and positive generators. Even though the two ion currents, $I_{-ion}$ and $I_{+ion}$, physically flow in the opposite directions as air ions, in the generator circuits, by the electrical convention, the currents flow in the same direction. These conditions can be summarized in two equations (1) or (2):

$$(I_{-pin})=(I_{-rtn})=(I'_{-ion})+(I_{-esc})+(I'_{+ion}) \quad (1), \text{ and}$$

$$(I_{+pin})=(I_{+rtn})=(I'_{+ion})+(I_{+esc})+(I'_{+ion}) \quad (2)$$

In the method described in this invention the ion currents flowing from and to the ionizing electrodes are measured as currents in the return paths 109 and 111 of the generators 9 and 11.

In one embodiment of the present invention, in the absence of the external electrical field when the surface 10 in the immediate vicinity of the ionizing electrodes carries no charge, the escaped ion currents ($I_{-esc}$) and ($I_{+esc}$) are very small, and substantially all ionizing current generated by the positive electrode 47 flows to the negative electrode 49, and substantially all ionizing current generated at the negative electrode 49 flows to the positive electrode 47. The equations (1) and (2) then take the following form:

$$(I_{-pin})=(I_{-rtn})=(I_{-ion})+(I_{+ion}) \quad (1a), \text{ and}$$

$$(I_{+pin})=(I_{+rtn})=(I_{+ion})+(I_{-ion}) \quad (2a).$$

These conditions are achieved by a combination of a specific distance between ionizing electrodes of the opposite polarities ranging from ¼" to about 2", where each ionizing electrode of positive polarity 47 is positioned in close proximity to an electrode of the negative polarity 49, and by the potential difference between the electrodes of opposite polarities of no lower than 2 kV and not higher than 10 kV. Under these conditions, the current $I_{+rtn}$ in the ground return path of the positive generator and the current $I_{-rtn}$ in the ground return path of the negative generator will be substantially equal, or ($I_{rtn}=I_{+rtn}$).

Furthermore, for a brand-new ionizer with sharp clean ionizing point electrodes the initial values $I_{o+rtn}$ and $I_{o-rtn}$ will be close to the maximum achievable by the ionizer. Measuring these values using the method of this invention provides information about the available ion output of the ionizer, or its ionizing efficiency.

Figure 1B:
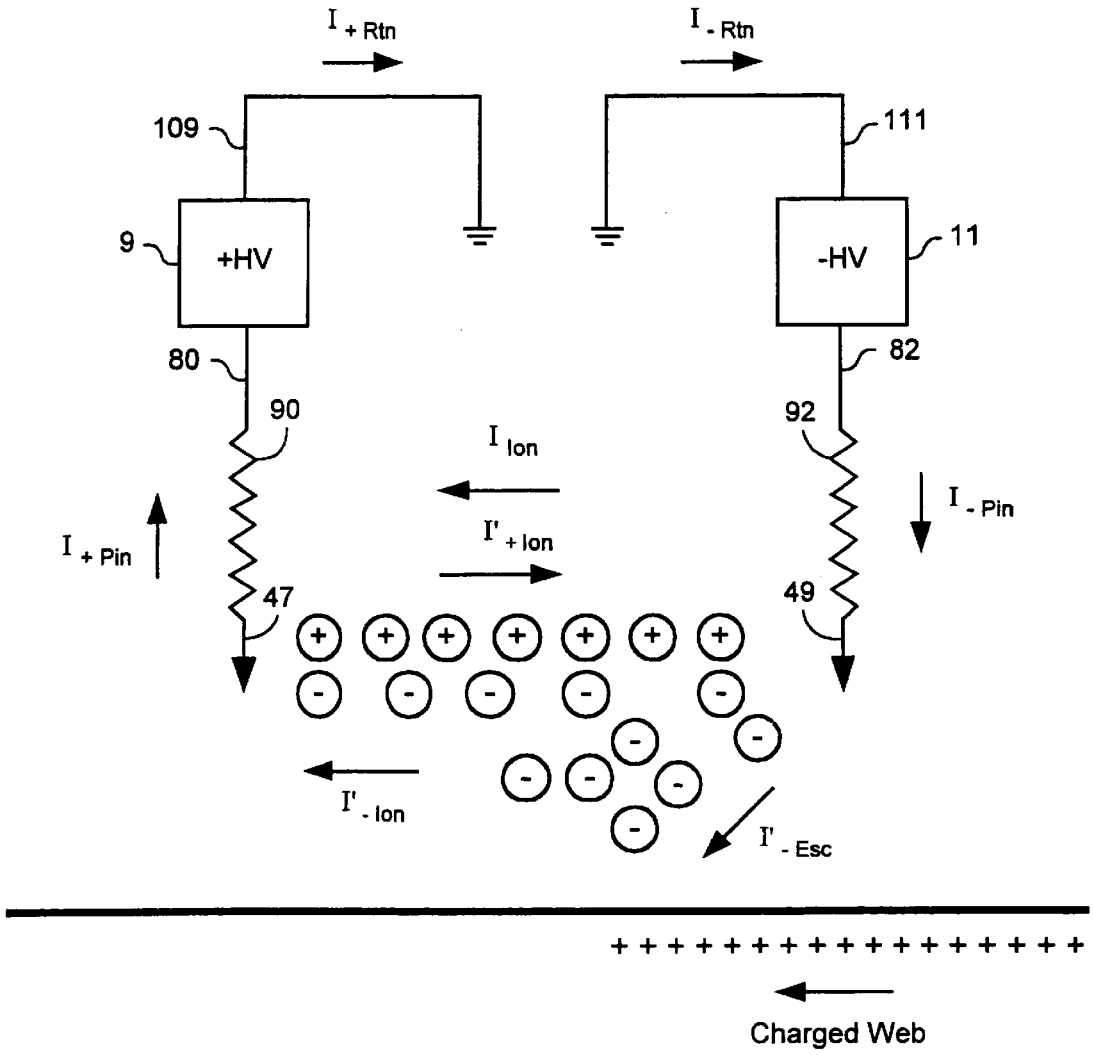
FIG. 1B shows a diagram of positive and negative ion currents and circuit currents in the ionizing method and device of the present invention in the presence of an external electrostatic field.

Referring now to FIG. 1B showing a condition where there is an external electrical field in the vicinity of the ionizer. When an adjacent moving surface 10 has a charge on it, for instance of positive polarity, the associated electrostatic field causes some ions of the polarity opposite to the polarity of the surface charge on the web, negative ions in this case, to flow to the charged surface. The escaped ion current $I_{esc}$ and the substantial ion current $I'_{-ion}$ still flowing from negative electrode 49 to the positive electrode 47, equal to the negative ion current generated by the negative electrode, $I_{-ion}$. Under these conditions substantially all generated positive ion current $I_{+ion}$ from the positive electrode 47 flows to the negative electrode 49.

These conditions are reflected in equations (1b) and (2b).

$$(I_{-pin})=(I_{-rtn})=(I'_{-ion})+(I_{-esc})+(I_{+ion}) \quad (1b), \text{ and}$$

$$(I_{+pin})=(I_{+rtn})=(I_{+ion})=(I'_{-ion}) \quad (2b).$$

Although under these new conditions, the currents in the ground paths of the generators will not be equal, for a brand-new ionizer, these values will substantially be close to the maximum ion currents the positive and negative electrodes are capable of generating. Measuring these values using the method of this invention provides information about the available ion output of the ionizer, or its ionizing efficiency.

Figure 1C:
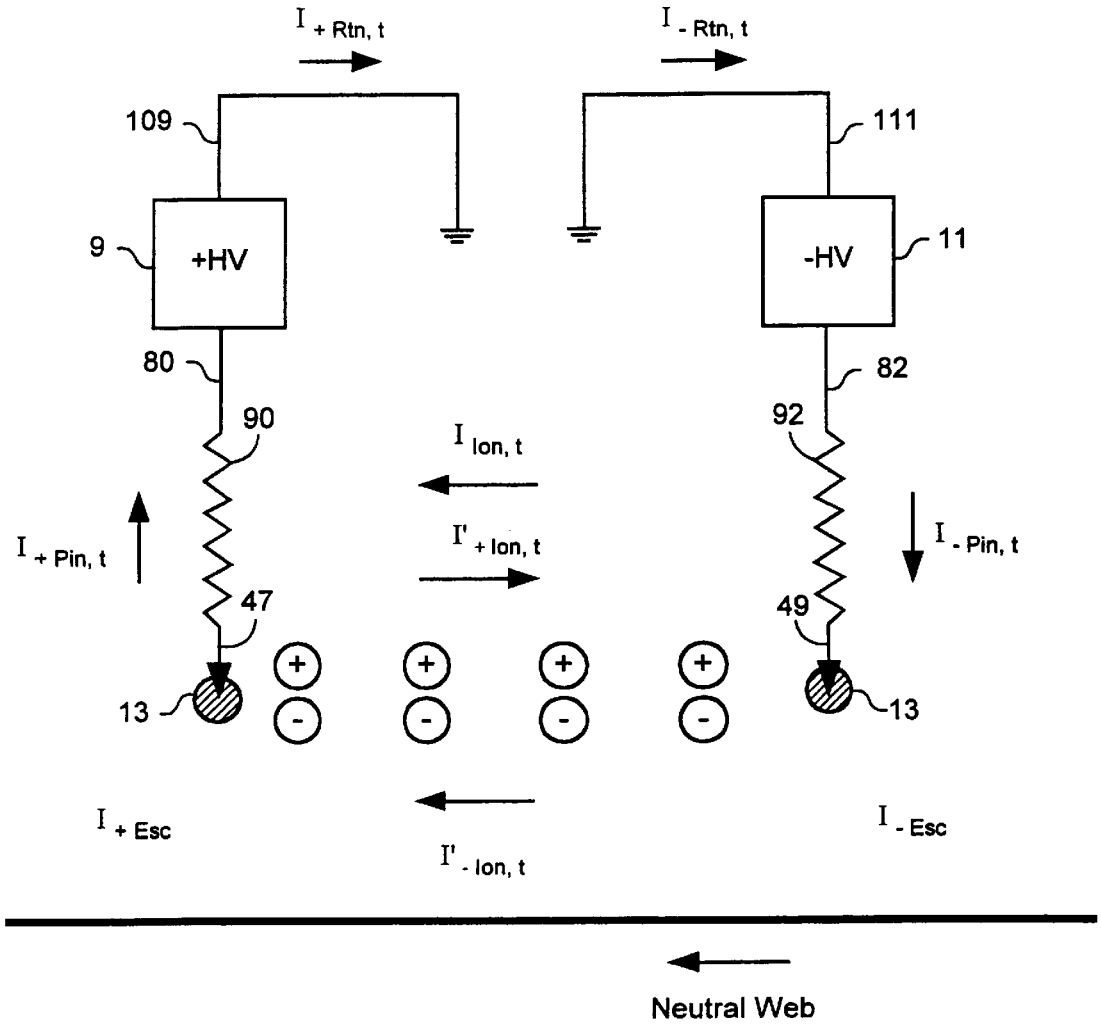
FIG. 1C is a diagram of positive and negative ion currents and circuit currents in the ionizing method and device of the present invention when the ionizing electrodes are contaminated, and in the absence of an external electrostatic field.

Referring now to FIG. 1C. With time (t) ionizing electrodes become contaminated by the residue 13 of the industrial process, dust, dirt, vapors of chemicals, etc., and the contamination that settles on the ionizing electrodes of the ionizer diminish its capacity for ion current generation. As in the above mentioned case of clean electrodes, substantially all ionizing current $I_{t+ion}$ from the positive electrode 47 flows to the negative electrode 49, and substantially all ionizing current $I_{t-ion}$ from negative electrode 49 flows to the positive electrode 47 in the absence of an external electrostatic field from the surface 10 (or when only a weak field is present) in the immediate vicinity of the ionizing electrodes. Under these changed conditions, the currents in the ground paths of both generators, although lower in values, may still be substantially equal. However, unlike the case of a brand-new ionizer with sharp clean ionizing point electrodes these values will be lower than the maximum achievable by the ionizer.

$$I_{t-ion}<I_{o+rtn} \quad (3), \text{ and}$$

$$I_{t+ion}<I_{o+rtn} \quad (4).$$

How much lower depends on the amount and nature of contamination 13 on the electrodes and their operating life.

It is also advantageous, as it will be shown in one embodiment of this invention, to ascertain the condition of the ionizer by measuring a sum of the absolute values of the signals proportional to the currents in the return paths of both generators, or $(I_{31\ rtn})+(I_{+rtn})$.

According to this invention, by measuring and monitoring the currents flowing in the return paths of the positive and negative generators, and comparing the measured values to the initial values, the user will be able to continually ascertain the condition of the ionizer as, for example as percentage of the initial value $$\frac{i_{t-ion}+i_{t+ion}}{i_{o-ion}+i_{o+ion}}\times 100\% = \frac{i_{t-rtn}+i_{t+rtn}}{i_{o-rtn}+i_{o+rtn}}\times 100\% = Effiency\,(\%). \quad (5)$$

Furthermore, a maintenance schedule can be established by choosing an arbitrary value of the currents below which the ionizer will be considered inefficient for its purpose, for instance when Efficiency=25%.

In another embodiment of this invention the values of the signals, $I_{+rtn}$ and $I_{-rtn}$ are scaled up or down. The scaling factor for the return currents will be based on the ionizer's length, or number of ionizing electrode pairs, i.e. pairs of positive and negative electrodes. Using this scaling allows to have a signal that is normalized regardless of the length of the ionizer and number of the ionizing electrodes.

Figure 2:
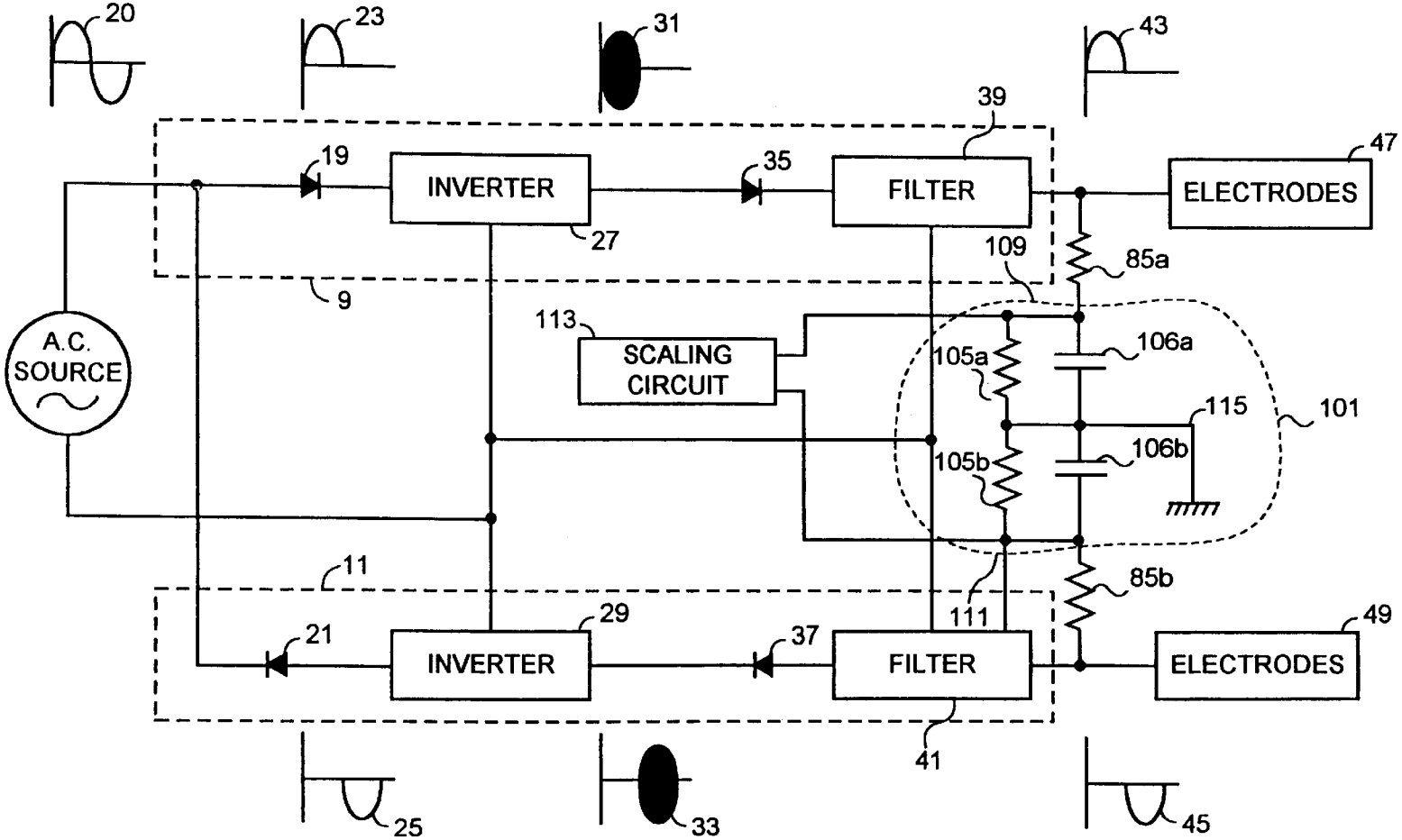
FIG. 2 is a block schematic diagram of one possible type of the high-voltage generators of FIG. 1A, 1B and 1C according to one embodiment of the invention.

Referring now to FIG. 2, there is shown a block schematic diagram of the circuit stages according to present invention. In one embodiment of the present invention the two high voltage generators 9, 11 are operated to produce positive or negative voltages of about 3–15 kilovolts during respective operational half-cycles at a selected switching or repetition rate as described in the U.S. Pat. No. 5,930,105 and U.S. Pat. No. 6,088,211. In operation during one half of the switching duty cycle, one generator produces only positive half-cycles of high-voltage and the other generator is substantially inactive. Then, during the alternate duty cycle, such other generator produces only negative half-cycles of high-voltage and the one generator is substantially inactive. The positive output voltage is made higher than the output voltage of the negative generator in order to generate equal positive and negative ion currents. For instance, the positive peak output voltage may be in the range from 6 kilovolts to 10 kilovolts, while the negative peak output voltage may be in the range from 4 kilovolts to 8 kilovolts. The operating duty cycles may be conveniently determined by power line frequency for alternately activating each of the separate high-voltage generators 9, 11 to produce half-cycles of high-voltage on the outputs 80, 82. Specifically, each generator 9, 11 includes circuitry for operating at high frequency of about 20 kilohertz on applied electrical power, and such high frequency operation conveniently reduces the size and weight of voltage step-up transformers used to produce the high peak output voltages of one or other polarities.

Referring again to FIG. 2, the high-voltage generators 9, 11 have resistors 105*a* and 105*b* in their respective ground return paths, that are connected to system ground 115. The generators 9, 11 receive alternate half waves of applied power (e.g., conventional AC power-line supply) via respective half-wave rectifiers 19, 21. The alternate half-cycles 23, 25 of the applied AC power 20 thus power the respective inverters 27, 29 to produce oscillations 31, 33 at high frequencies of about 20 kilohertz only during alternate half-cycles of the applied AC power 20. Such high-frequency oscillations at high-voltages of about 3–15 kilovolts are then half-wave rectified by respective diodes 35, 37 to supply the resultant half-wave rectified, high-frequency, high voltages to the respective filters 39, 41. These filters remove the high-frequency components of the half-wave rectified voltages to produce respective high-voltage outputs 43, 45 that vary over time substantially as the half-wave rectified, applied AC power 23, 25 varies with time. The filtered output voltages 43, 45 are supplied to separate respective sets of ion emitter electrodes 47, 49 of the type and orientation, as previously described. Two resistors 85*a* and 85*b* are connected between the outputs of the high voltage generators and the ground return electrical paths 109 and 111, respectively. The resistors 85*a* and 85*b* act as drain resistors to provide substantially zero potential on the output and associated electrode 47, 49 that is inactive during an alternate half-duty cycle.

According to the present invention, a metering circuit 101 consists of two serially connected resistors 105*a* and 105*b* of equal resistance values that are included in the ground return paths of each of the generators 9 and 11. The voltage drop across these resistors is a measure of the current flowing in each corresponding return path. Each of the resistors 105*a* and 105*b* are connected in series with resistors 85*a* and 85*b* respectively. This connecting scheme allows to utilize the drain resistors 85*a* and 85*b* for the purpose of pulling down the output voltage during the respective generator's off cycle, and yet allows to isolate and measure the pin current. Capacitors 106*a* and 106*b* connected in parallel with resistors 105*a* and 105*b* to filter out fluctuations of the ion current signal at the operating frequency and its harmonics and produce a DC component signal proportional to the DC component of ion current. The voltage drops across resistors 105*a* and 105*b* could be measured by a DC voltmeter or a similar instrument. Although there is a certain advantage in measuring the positive and negative pin currents individually, it is more advantageous to measure a sum of the two currents, as it is done in one embodiment of the invention. The serial connection of the resistors 105*a* and 105*b* serve this specific purpose, as the voltage drop across both resistors can be measured and monitored.

According to this invention the voltage drop across the serially connected resistors 105*a* and 105*b* is measured and monitored. Because the number of ionizing electrodes connected to the outputs of the generators vary depending on the width of the material to be neutralized, the values of the voltage across the resistors is scaled up or down with a signal processing and scaling circuit 113. The scaling factor for the return currents will be based on the ionizer's length, or number of ionizing electrode pairs, i.e. pairs of positive and negative electrodes. Using this scaling allows to have a signal that is normalized regardless of the length of the ionizer and number of the ionizing electrodes.

Figure 3:
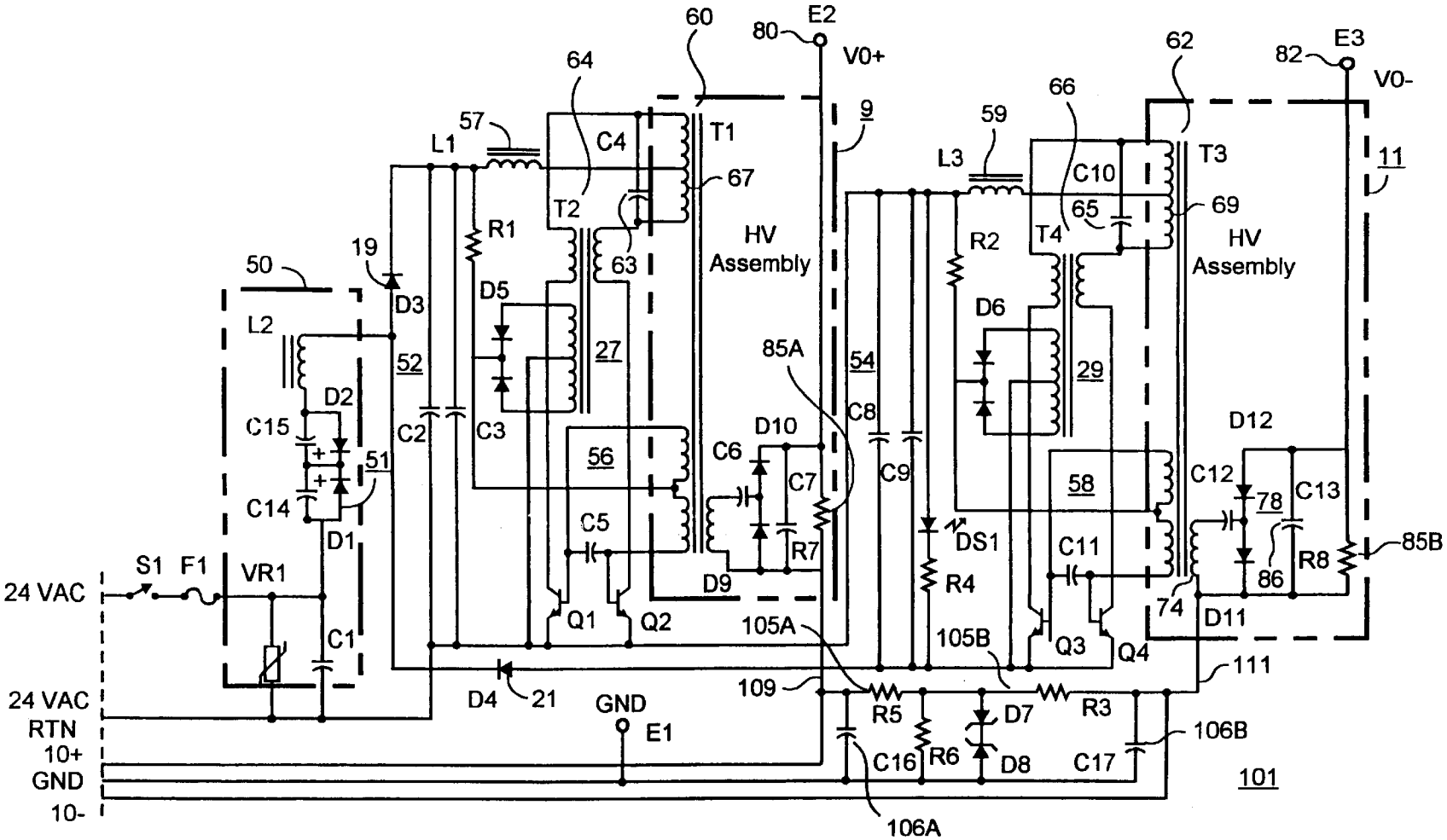
FIG. 3 is a circuit diagram of the generators of FIG. 2.

Referring now to the circuit diagram of FIG. 3, (a similar circuit was described in the U.S. Pat. No. 5,930,105 and in U.S. Pat. No. 6,088,211, the differences include the resistors 85*a* and 85*b*, and 105*a* and 105*b*). There is shown an input filter network 50 including a varistor and inductive and capacitive elements for protecting against power-line voltage transients and electromagnetic interference. There is also shown the safety circuit 51 which was described in detail in U.S. Pat. No. 6,088,211. The safety circuit includes a dual diode-capacitor network connected in the supplied voltage line to redistribute automatically the voltage supplied to one or the other high voltage generator depending on their relative power consumption. That applied AC power at line, or other, frequency and any convenient voltage level (e.g., 24 volts, 120 volts, 220 volts, etc.) is applied via diodes 19, 21 to respective high-frequency inverters 27, 29. For each inverter, the half-wave rectified applied AC voltage is filtered 52, 54 for application to the high-frequency oscillators 56, 58 that include voltage step-up transformers 60, 62. The step-up transformers 60, 62 each includes windings connected in respective drain or collector circuits of transistor pairs 68, 70. The step-up transformers include windings coupled to the base or gate circuits of the transistor pair to form regenerative feedback loops that sustain oscillating operation during conduction of power-line current through the associated diode 19, 21, substantially at a frequency determined by the tank circuit of capacitance 63, 65 and the primary inductance of winding 67, 69. The inductors 57, 59 smooth current flow to the parallel-resonant tank circuits of coils 67, 69 and capacitors 63, 65. Current transformers 64, 66 sample the collector or drain currents of transistor pair 68, 70 to provide a proportional current of reduced magnitude to drive the transistor pair 68, 70. The proportional drive current allows operation over a wide range of input voltages encountered during the half-sine wave variations in each alternate cycle.

Each step-up transformer 60 and 62 includes output winding 72 or 74 connected to capacitive voltage doubler circuits 76, 78 that produce rectified high-voltages on output terminals 80, 82 of one or other polarity. The rectified output voltages filtered via capacitors 84, 86 to provide the output voltages 43, 45 (see FIG. 2) that are applied to the respective ion emitter electrodes 47, 49. The output voltages 43, 45 should be adjusted to such levels relative to each other, or to the system ground, that the positive and negative ion currents flowing between ionizing electrodes 47, 49 are of substantially equal magnitude. Two high-voltage rated resistors 85*a* and 85*b* of high resistance (e.g., 50 megohms) are connected between output terminals of the respective generators and the inputs of the metering circuit 101. These resistors are used to discharge the filter capacitors 84, 86.

The metering circuit 101 utilized to measure the DC component of the return currents in the system ground will be described in more detail. Electrical charges of polarities opposite to the charges on the ionizing electrodes are conducted away from the generators through the ground return electrical path 109 of the positive high-voltage generator 9 and ground return electrical path 111 of the negative high-voltage generator 11. The resistors 105*a* and 105*b* are placed in the respective ground return paths 109 and 111 of the two high voltage generators. These resistors function as return current sensing resistors. Further components of the metering circuit include resistor (R6) connected to the junction between the resistor 105*a* and 105*b* and system ground, and two capacitors 106*a* and 106*b*, connected in essence parallel with resistors 105*a* and 105*b* to serve as filters. The voltage drop across the serially connected resistors 105*a* and 105*b* could be measured by a DC voltmeter or a similar instrument.

Figure 4:
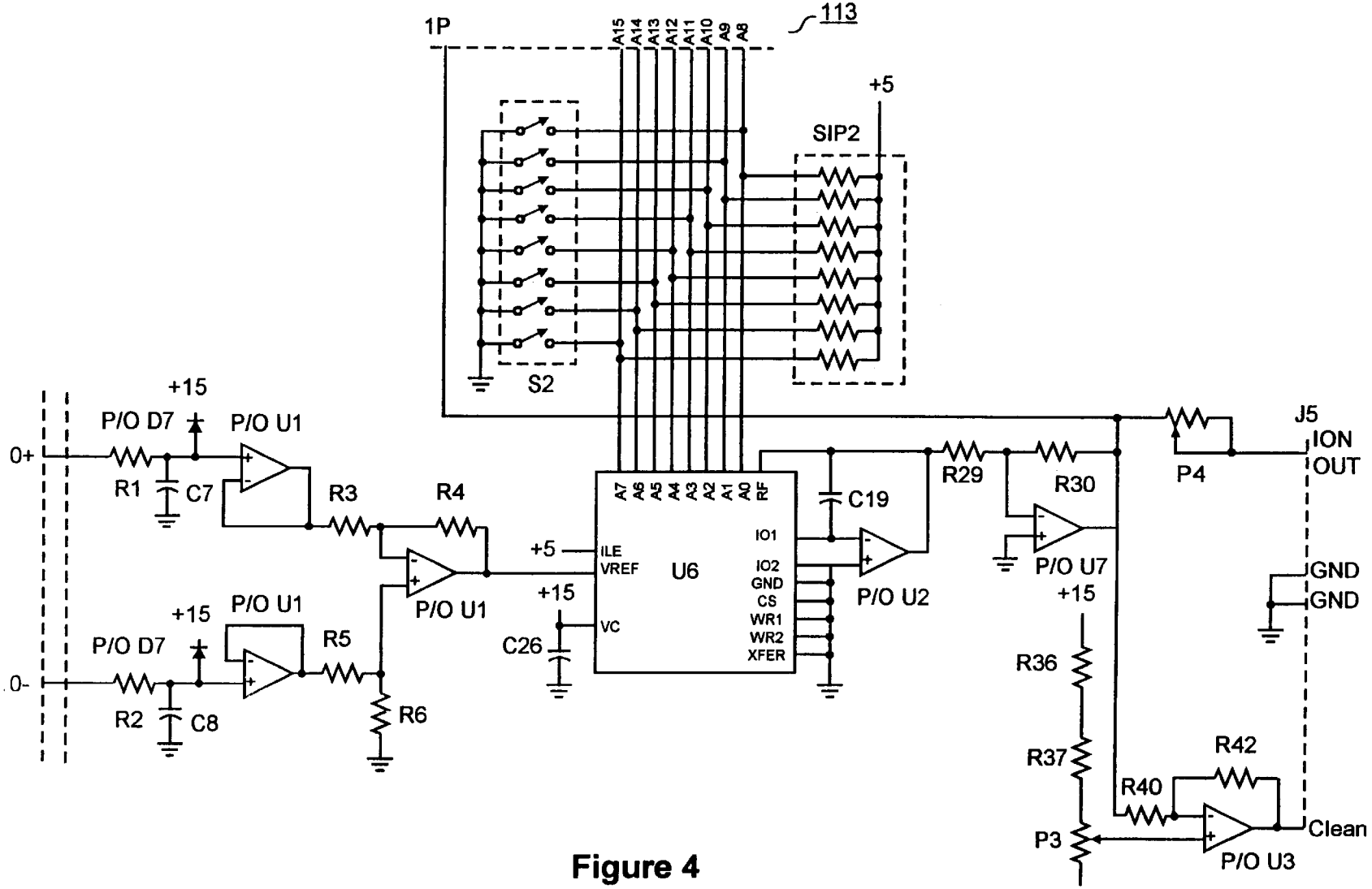
FIG. 4 is a circuit diagram of the signal processing and scaling circuit according to one embodiment of the present invention.

Referring now to FIG. 4, there is shown the signal processing and scaling circuit 113 shown as a block in FIG. 2. Amplifier U1 forms an instrumentation amplifier having a high impedance input and low impedance output. The input, at resistors R1 and R2, connect across resistors 105*a* and 105*b* in the high-voltage generator. The instrumentation amplifier provides voltage gain on the order of 3 (at test point TP1) as determined by resistors R3 through R6. The output of the instrumentation amplifier feeds to a multiplying digital to analog converter. The switch settings of S2 multiplied by the instrument amplifier output sets the output of amplifier U2.

From input to output the gain of the circuitry can be expressed as $$V_0 = I_{+pini} * R105 * K1 * \frac{f(S2)}{256}$$

where

K1—amplifier gain, f(S2)—switch position expressed in binary from 0 to 255.

Operation of the system can be described by considering that, for example, all ionizers have between 8 and 80 positive and 8 and 80 negative electrodes. With the smallest ionizer, the output of the instrumentation amplifier, test point TP1, will typically be 1.0 V. Setting switch S2 to 255, the output of the multiplying digital to analog converter will be 1.0 V×255/256 or 0.996 V. For the largest ionizer, the output of the same instrumentation amplifier will be 10.0 V. Setting switch S2 to 25, the output of the multiplying digital to analog converter will be 10.0 V×25/256 or 0.976 V. As described, the monitoring system can be made to operate virtually independent of the number of positive and negative electrodes. The output of the comparator U3 can be attached to an audio or visual alarm that would alert the operator to clean ionizing electrodes when the pin current falls below a value set by the potentiometer P3.

What is claimed is:

1. A method for monitoring ion currents generated at first and second electrodes of an air ionizer in order to determine whether the air ionizer is operating efficiently, the method comprising:

generating a positive voltage at a first electrode;

generating a negative voltage at a second electrode;

positioning the second electrode in proximity to the first electrode such that a flow of positive ion current is established between the first and second electrodes and a flow of negative ion current is established between the second and first electrodes;

measuring a total cross-electrode ion current between the first and second electrodes; and comparing the total cross-electrode ion current each time it is measured to an initial total cross-electrode ion current in order to determine the efficiency of the air ionizer.

2. The method of claim 1, wherein the step of comparing includes:

dividing the total cross-electrode ion current each time it is measured by the initial total cross-electrode ion current in order to obtain a fractional efficiency percentage; and multiplying the fractional efficiency percentage by one-hundred in order to obtain an overall efficiency percentage of the air ionizer at the time the total cross-electrode ion current is measured.

3. The method of claim 1, wherein said initial total cross-electrode ion current is determined at the beginning of service of the air ionizer as a benchmark of the ionizing efficiency of the electrodes.

4. The method of claim 3, wherein the initial total cross-electrode ion current is determined by:

generating an initial positive voltage at the first electrode at the beginning of service of the air ionizer;

generating an initial negative voltage at the second electrode at the beginning of service of the air ionizer;

positioning the second electrode in proximity to the first electrode such that an initial flow of positive ion current is established between the first and second electrodes and an initial flow of negative ion current is established between the second and first electrodes;

measuring the initial total cross-electrode ion current between the first and second electrodes at the beginning of service of the air ionizer.

5. The method of claim 1, wherein the step of measuring the total cross-electrode ion current between the first and second electrodes includes:

measuring a sum of the positive ion current flowing from the first electrode to the second electrode and the negative ion current flowing from the second electrode to the first electrode at a first interval in time.

6. The method of claim 1, where said positive and negative voltages at the first and second electrodes are generated intermittently and alternately.

7. The method of claim 6, where one of said positive and negative voltages is generated to produce its full output while the other one of said positive and negative voltages is substantially zero.

8. The method of claim 1, further comprising:

determining when to clean the electrodes based on the results of the comparison between the total cross-electrode ion current with the initial total cross-electrode ion current.

9. An apparatus for controlling charge on an object, the apparatus comprising:

a first electrode;

a second electrode;

a ground node;

a first high-voltage generator coupled to the first electrode for generating a positive voltage such that a positive ion current may flow from the first electrode to the second electrode;

a return terminal and an output terminal in said first high-voltage generator;

a second high-voltage generator coupled to the second electrode for generating a negative voltage such that a negative ion current may flow from the second electrode to the first electrode;

a return terminal and an output terminal in said second high-voltage generator; and a cross-electrode ion current measuring circuit coupled between the return terminal of the first high voltage generator and the return terminal of the second high voltage generator for measuring the sum of the negative ion current which flows from the second electrode to the first electrode and the positive ion current which flows from the first electrode to the second electrode, wherein the cross-electrode ion current measuring circuit measures a total cross-electrode ion current between the first electrode and the second electrode and compares the total cross-electrode ion current to an initial total cross-electrode ion current in order to determine whether the first electrode and the second electrode are operating efficiently.

10. The apparatus of claim 9, where the first and second electrodes are spaced apart a distance at which substantially all of the positive ion current flows from the first electrode to the second electrode and all of the negative ion current flows from the second electrode to the first electrode in the absence of an external electrostatic field within the vicinity of said first and second electrodes.

11. The apparatus of claim 9, wherein the cross-current measuring circuit is comprised of:

a resistor coupled between the return terminals of the first and second high voltage generators; and a voltmeter coupled across the resistor for measuring a total voltage drop across the resistor, wherein the voltage drop across the resistor is determinative of the sum of negative ion current flowing from the second electrode to the first electrodes and the positive ion current flowing from the first electrode to the second electrode.

12. The apparatus of claim 9, wherein the cross-current measuring circuit is comprised of:

a first resistor coupled between the return terminal of the first high voltage generator and the ground node;

a second resistor coupled between the return terminal of the second high voltage generator and the ground node; and a voltmeter coupled across the first and second resistors for measuring a total voltage drop across both resistors wherein the total voltage drop across the first and second resistors is determinative of the sum of the negative ion current flowing from the second electrode to the first electrodes and the positive ion current flowing from the first electrode to the second electrode.

13. The apparatus of claim 12, wherein said first and second resistors are substantially identical in value.

14. The apparatus of claim 12, wherein the cross-electrode ion current measuring circuit further comprises:

a scaling circuit for scaling the voltage measured across the first and second resistors.

15. The apparatus of claim 9, further comprising:

an indicator for alerting a user when to clean the electrodes; wherein the indicator is activated based upon the results of the comparison between the total cross-electrode ion current with the initial total cross-electrode ion current.

16. The apparatus of claim 9, further comprising:

circuitry for actuating said first and second high-voltage generators to supply, respectively, the positive and negative high voltages intermittently and alternately to the first and second electrodes, respectively, at a frequency which is substantially equal to a power line frequency.

17. The apparatus of claim 12, further comprising:

a first filter capacitor coupled in parallel with the first resistor; and a second filter capacitor coupled in parallel with the second resistor, wherein the first and second capacitors serve to produce DC voltages across the first and second resistors, respectively.

18. The apparatus of claim 16, further comprising:

a first high voltage rated resistor coupled between the output and return terminals of the first high-voltage generator for acting as a drain resistor and providing substantially zero output voltage to the first electrode when the first high voltage generator is not actuated; and a second high voltage rated resistor coupled between the output and return terminals of the second high-voltage generator for acting as a drain resistor and providing substantially zero output voltage to the second electrode when the second high voltage generator is not actuated.

19. The apparatus of claim 16, wherein the first high-voltage generator is inactive during a first part of a duty cycle, and the second high-voltage generator is inactive during a second part of the duty cycle.

* * * * *